US009761929B1

(12) United States Patent
McPhearson

(10) Patent No.: US 9,761,929 B1
(45) Date of Patent: Sep. 12, 2017

(54) MULTI BANDWIDTH CELLULAR ANTENNA

(71) Applicant: Dennis D. McPhearson, Baytown, TX (US)

(72) Inventor: Dennis D. McPhearson, Baytown, TX (US)

( * ) Notice: Subject to any disclaimer, the term of this patent is extended or adjusted under 35 U.S.C. 154(b) by 3 days.

(21) Appl. No.: 15/138,498

(22) Filed: Apr. 26, 2016

(51) Int. Cl.
*H01Q 9/04* (2006.01)
*H01Q 1/24* (2006.01)
*H01Q 15/16* (2006.01)

(52) U.S. Cl.
CPC ..... *H01Q 1/243* (2013.01); *H01Q 15/16* (2013.01)

(58) Field of Classification Search
CPC ..... H01Q 9/04; H01Q 9/0414; H01Q 1/38; H01Q 1/48; H01Q 13/08; H01Q 15/14; H01Q 15/16
See application file for complete search history.

(56) References Cited

U.S. PATENT DOCUMENTS 4,827,271 A * 5/1989 Berneking ..... H01Q 9/0414 343/700 MS
6,897,813 B2 * 5/2005 Higasa ..... H01Q 9/0435 343/700 MS
2008/0036665 A1 * 2/2008 Schadler ..... H01Q 1/42 343/700 MS

FOREIGN PATENT DOCUMENTS

JP EP 1555721 A1 * 7/2005 ..... H01Q 9/0407

* cited by examiner

*Primary Examiner* — Hoang Nguyen
(74) *Attorney, Agent, or Firm* — Dunlap Bennett & Ludwig PLLC

(57) ABSTRACT

An antenna is provided. The antenna includes a reflector. The reflector is formed of a metal having a high electrical conductivity. The reflector includes a lower plate and an upper plate. The lower plate includes a curved upper surface having a cross section shape of a parabola. The upper plate is disposed above the lower plate forming a space in between. The lower plate includes a larger diameter than the upper plate. The present invention further includes a first leg electrically connecting the lower plate and the upper plate together. A radio frequency connector is connected to one of the lower plate and the upper plate. A coaxial cable extending from the radio frequency connector is electrically connected to the other of the lower plate and the upper plate.

10 Claims, 3 Drawing Sheets

MULTI BANDWIDTH CELLULAR ANTENNA

BACKGROUND OF THE INVENTION

The present invention relates to antennas and, more particularly, to a multi bandwidth cellular antenna that receives and transfers signal within a confined space.

An antenna is an electrical device which converts electric power into radio waves, and vice versa. It is usually used with a radio transmitter or radio receiver. In transmission, a radio transmitter supplies an electric current oscillating at radio frequency (i.e. a high frequency alternating current (AC)) to the antenna's terminals, and the antenna radiates the energy from the current as electromagnetic waves (radio waves). In reception, an antenna intercepts some of the power of an electromagnetic wave in order to produce a tiny voltage at its terminals that is applied to a receiver to be amplified. Currently, antennas are unable to receive and transmit signal when in a confined space.

As can be seen, there is a need for an antenna that receives and transmits signal from within a confined space.

SUMMARY OF THE INVENTION

In one aspect of the present invention, a multi bandwidth cellular antenna comprises: a reflector formed of a metal comprising a high electrical conductivity, wherein the reflector comprises: a lower plate comprising a curved upper surface having a cross sectional shape of a parabola; and an upper plate, wherein the upper plate is disposed above the lower plate forming a space in between, and the lower plate comprises a larger diameter than the upper plate; at least a first leg electrically connecting the lower plate to the upper plate; and a radio frequency connector comprising a coaxial cable, wherein the radio frequency connector is secured to one of the lower plate and the upper place, and the coaxial cable is electrically connected to the other of the lower plate and the upper plate.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a multi bandwidth cellular antenna that is able to receive and transmit radio waves from a confined space. The present invention includes an antenna with an upper reflector and a lower reflector having a parabolic shape, which directs and intakes signal frequency upward and outward. Therefore, if there are holes or cracks within the confined space, the radio device transmits and receives signal by penetrating or seeping through the cracks/holes.

Figure 1:
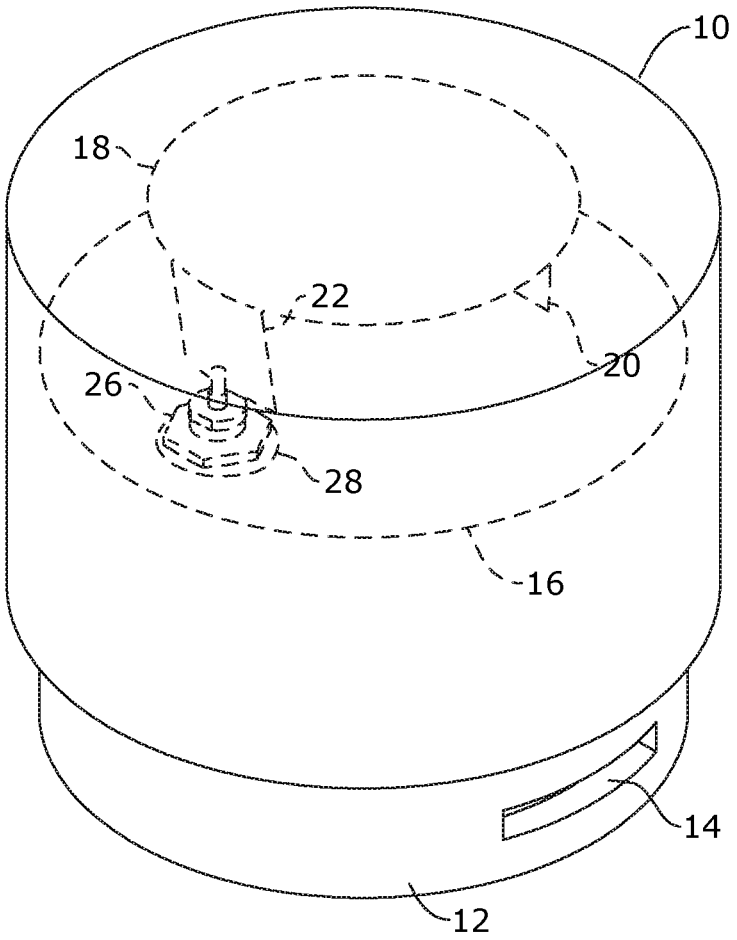
FIG. 1 is a perspective view of an embodiment of the present invention.
Figure 2:
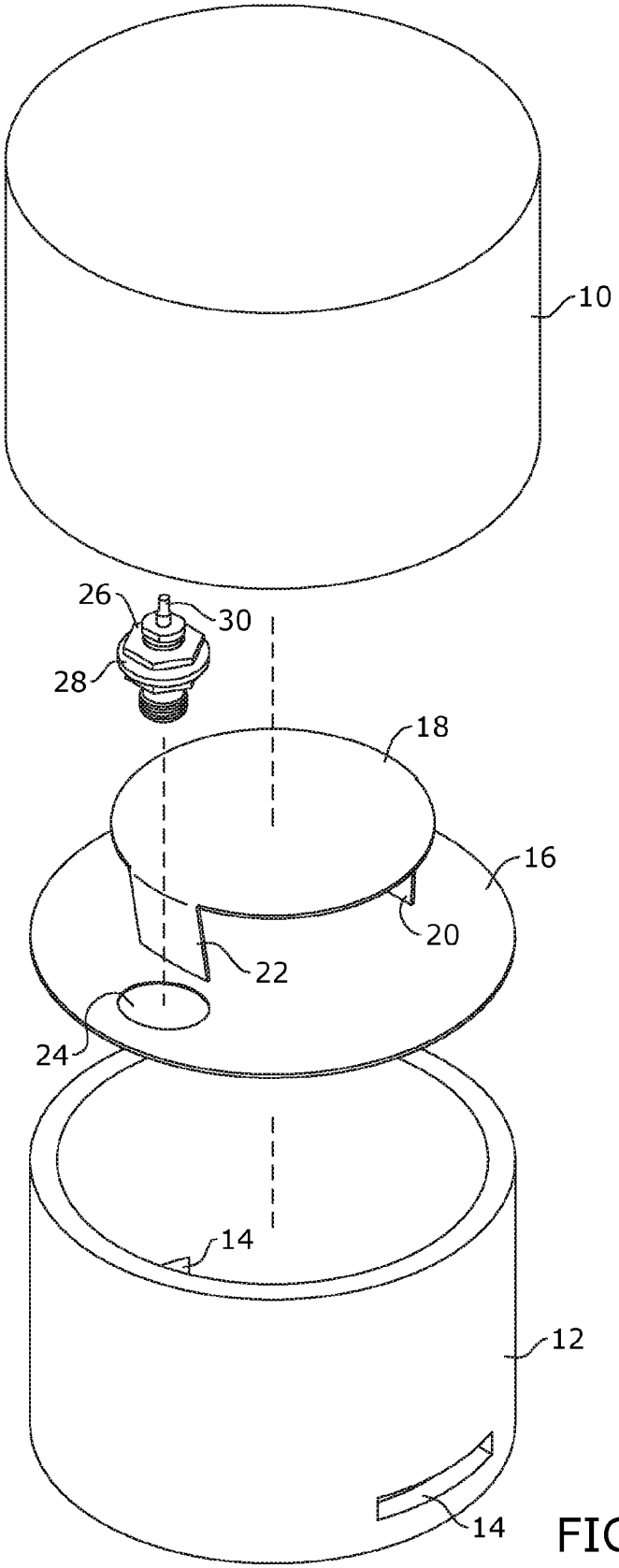
FIG. 2 is an exploded view of an embodiment of the present invention.
Figure 3:
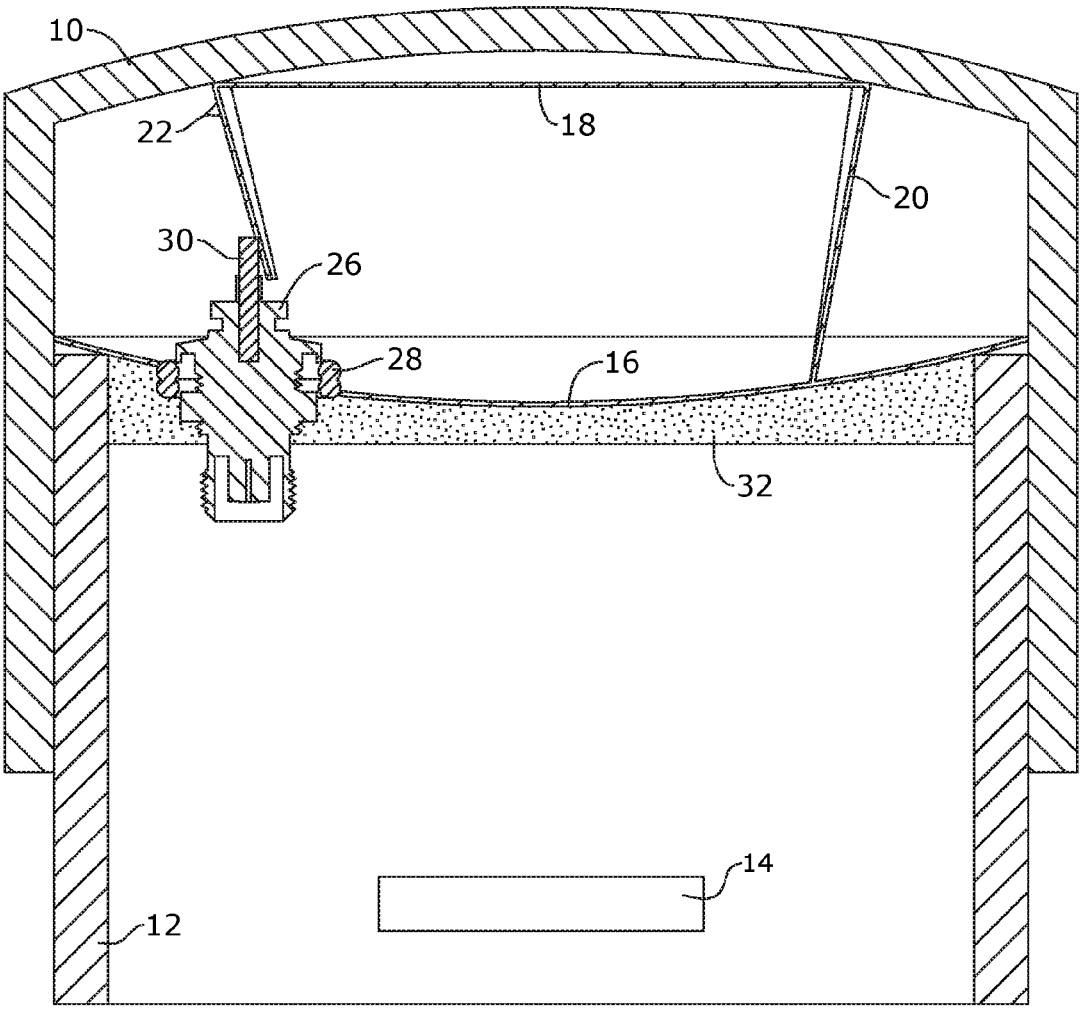
FIG. 3 is a section view of an embodiment of the present invention.

Referring to FIGS. 1 through 3, the present invention includes an antenna 100. The antenna 100 includes a reflector 200. The reflector 200 is formed of a metal having a high electrical conductivity. The reflector 200 includes a lower plate 16 and an upper plate 18. The lower plate 16 may include a curved upper surface having a cross section shape of a parabola, curving away from the upper plate 18. The upper plate 18 may be substantially flat or may include a curved lower surface having a cross section shape of a parabola, curving away from the lower plate 16. The upper plate 18 is disposed above the lower plate 16 forming a space in between. The space may be about 2 to about 3 inches. For example, the space may be about 2.68 inches. The lower plate 16 includes a larger diameter than the upper plate 18. The present invention further includes a first leg 20 electrically connecting the lower plate 16 and the upper plate 18 together. A radio frequency connector 26 is connected to one of the lower plate 16 and the upper plate 18. A coaxial cable 30 extending from the radio frequency connector 26 is electrically connected to the other of the lower plate 16 and the upper plate 18.

As mentioned above, the metal of the present invention may be any metal that has a high electrical conductivity. For example, the metal may be copper. In such embodiments, the lower plate 16, upper plate 18 and the first leg 20 may be made of 21 gauge copper sheet. However, the present invention may include other types of metals with high electrical conductivity. For example, the metal may include silver, gold, aluminum, brass, zinc, nickel, iron, tin, bronze, steel, lead and the like.

In certain embodiments, the radio frequency connector 26 may be a Neil Concelman connector. In certain embodiments, the radio frequency connector 26 may be a threaded Neil Concelman connector. The coaxial cable 30 may be an RG58/U cable.

The radio frequency connector 26 may be secured to an aperture 24 formed through the lower plate 16 by a gasket 28. The gasket 28 is made of a non-conductive material such as rubber or another polymer. In such embodiments, the coaxial cable 30 is electrically connected to the upper plate 18. For example, a second leg 22 may electrically connect the coaxial cable 30 to the upper plate. The first leg 20 and the second leg 22 may be vertically disposed and extend downwards from the upper plate 18 towards the lower plate 16.

The present invention may further include a housing 10, 12. The housing 10, 12 may be made of a non-conductive material, such as a polymer, including, but not limited to, plastic or PVC. The reflector 200 is disposed within the housing 10, 12. The housing 10, 12 may include a shaft 12 and a cap 10. The shaft 12 may include an upper rim forming an entrance into the housing 10, 12. The cap 10 is removeably secured over the upper rim and thereby covers the entrance. A rubber glue 32 may secure the reflector 200 within the housing. The rubber glue 32 may keep the antenna 100 of the present invention water proof, and prevent the corrosion of the metal. Further, the rubber glue 32 may support the radio frequency connector 26 in an upright vertical position.

In certain embodiments, an aperture 14 may be formed through a portion of the housing 10, 12. The aperture 14 may be in the form of a slot. The slot may be formed through a lower end of the shaft 12. The antenna may be mounted to a bracket via the slot in a vertical position in the confined space.

The flat round surfaces of the antenna 100 act like a miniature dish with the shape of a paraboloid. A parabolic reflector 200 has a high degree of directivity and has the ability to focus radio frequency (RF) energy into a beam, much like a flashlight. The Hybrid Parabolic antenna 100 has a very narrow beam width, usually not exceeding 25 degrees. As mentioned above, the upper plate 18 is disposed above the lower plate 16, which forms an antenna 100 that transfer radio frequency from the lower plate 16 to the upper plate 18. The radio frequency seeps through cracks/holes when the present invention is located in confined spaces and contacts the outer signals in the atmosphere.

A method of making the present invention may include the following. A five inch circular lower plate and a three inch circular upper plate with legs may be cut from 21 gauge copper plate. The next step is to bend one of the legs of the upper plate and solder the leg to the bottom plate. The third step is to drill a ¾" hole into the bottom plate, insert a male TNC connector into the hole, insulate the TNC connector from touching the bottom plate by installing a rubber non-conductive "Grommet" into the plate hole and then pushing the TNC connector through it and securing it from popping out with hot glue and weld it to the feeder piece. The fourth step is to cut a 2.75" tall piece of SCH40 PVC Conduit. Two slits may be formed through the PVC conduit for the hanging brackets. Place the copper parts into a 4" PVC cap and push into the conduit until a slight 0.13"-0.25" upward bend to the bottom copper plate is seen. The present invention may include sizes varying from the sizes listed above, and the varying sizes are thereby encompassed in the scope of the present invention. After all is fixed in place the antenna is turned upside down and a 3M epoxy sealant is poured into the bottom of the antenna to seal and water proof all components.

It should be understood, of course, that the foregoing relates to exemplary embodiments of the invention and that modifications may be made without departing from the spirit and scope of the invention as set forth in the following claims.

What is claimed is:

1. A multi bandwidth cellular antenna comprising:

a reflector formed of a metal comprising a high electrical conductivity, wherein the reflector comprises:

a lower plate comprising a curved upper surface having a cross sectional shape of a parabola; and an upper plate, wherein the upper plate is disposed above the lower plate forming a space in between, and the lower plate comprises a larger diameter than the upper plate;

at least a first leg electrically connecting the lower plate to the upper plate; and a radio frequency connector comprising a coaxial cable, wherein the radio frequency connector is secured to one of the lower plate and the upper place, and the coaxial cable is electrically connected to the other of the lower plate and the upper plate.

2. The antenna of claim 1, wherein the lower plate comprises an aperture formed therethrough, wherein the radio frequency connector is secured within the aperture by a gasket comprising a non-conductive material and the coaxial cable is electrically connected to the upper plate.

3. The antenna of claim 2, further comprising a second leg electrically connecting the coaxial cable to the upper plate.

4. The antenna of claim 3, wherein the first leg and the second leg are vertically disposed and extend downward from the upper plate.

5. The antenna of claim 1, wherein the radio frequency connector is Neill-Concelman connector.

6. The antenna of claim 5, wherein the coaxial cable is an RG58/U cable.

7. The antenna of claim 1, wherein the metal is copper.

8. The antenna of claim 1, further comprising a housing formed of a non-conductive material, wherein the reflector is disposed within the housing.

9. The antenna of claim 8, wherein the housing comprises a shaft comprising an upper rim forming an entrance into the housing, and a cap removeably secured over the upper rim and thereby covering the entrance.

10. The antenna of claim 9, wherein the housing further comprises at least one aperture formed through the shaft.

* * * * *